US010307632B1

(12) United States Patent
Santana

(10) Patent No.: US 10,307,632 B1
(45) Date of Patent: Jun. 4, 2019

(54) ELASTIC BAND EXERCISE ASSEMBLY

(71) Applicant: Juan Carlos Santana, Boca Raton, FL (US)

(72) Inventor: Juan Carlos Santana, Boca Raton, FL (US)

( * ) Notice: Subject to any disclaimer, the term of this patent is extended or adjusted under 35 U.S.C. 154(b) by 16 days.

(21) Appl. No.: 15/267,254

(22) Filed: Sep. 16, 2016

(51) Int. Cl.
*A63B 21/055* (2006.01)
*A63B 21/00* (2006.01)
*A63B 23/12* (2006.01)

(52) U.S. Cl.
CPC .... *A63B 21/0557* (2013.01); *A63B 21/00043* (2013.01); *A63B 21/4035* (2015.10); *A63B 23/1209* (2013.01); *A63B 21/0004* (2013.01); *A63B 21/00061* (2013.01)

(58) Field of Classification Search
CPC ..... A63B 21/0557; A63B 21/4035; A63B 21/00043; A63B 21/0004; A63B 21/00058; A63B 21/00061; A63B 23/1209
See application file for complete search history.

(56) References Cited

U.S. PATENT DOCUMENTS

| | | | | |
|---|---|---|---|---|
| 5,800,322 | A * | 9/1998 | Block | A63B 21/0004 482/126 |
| 6,202,263 | B1 * | 3/2001 | Harker | B62J 7/08 114/230.2 |
| 6,497,641 | B1 | 12/2002 | Hinds | |
| 6,676,576 | B1 * | 1/2004 | Wu | A63B 21/0004 482/126 |
| 6,923,750 | B1 | 8/2005 | Hinds | |
| 6,979,286 | B1 | 12/2005 | Hinds | |
| 7,344,485 | B1 | 3/2008 | Simpson et al. | |
| 7,357,762 | B1 | 4/2008 | Terry et al. | |
| 7,458,135 | B2 | 12/2008 | Mikesell et al. | |
| 7,819,787 | B2 * | 10/2010 | Kassel | A63B 21/00043 24/300 |
| 9,216,313 | B1 | 12/2015 | Wu | |
| 2009/0176634 | A1 * | 7/2009 | Wu | A63B 21/0004 482/122 |

* cited by examiner

*Primary Examiner* — Megan Anderson
(74) *Attorney, Agent, or Firm* — Daniel S. Polley, P.A.

(57) ABSTRACT

An elastic exercise safety cord assembly, having an elastic tubing with first and second ends, an exterior wall, and an elongated cavity having a first diameter. The elastic tubing stretches a first predetermined length. First and second end plugs are secured inside the elongated cavity at the respective first and second ends, with a widest portion of each first and second end plugs closest to its respective first and second ends. A cord has third and fourth ends that is threaded through the elastic tubing and the first and second end plugs. The cord is a second predetermined length that is shorter than the first predetermined length.

16 Claims, 6 Drawing Sheets

Prior Art

ELASTIC BAND EXERCISE ASSEMBLY

BACKGROUND OF THE INVENTION

1. Field of the Invention

The present invention relates to exercise equipment, and more specifically, to interchangeable elastic safety cords for exercise and resistance-training devices.

2. Description of the Related Art

Applicant believes that one of the closest references corresponds to U.S. Pat. No. 9,216,313 B1, issued on Dec. 22, 2015 to Yung-Cheng Wu for Elastic cord for a pull exercise. However, it differs from the present invention because Wu teaches an elastic cord including a hollow outer elastic cord having a first end and a second end spaced from the first end in a longitudinal direction. The hollow outer elastic cord further includes an outer periphery and an inner periphery spaced from the outer periphery in a radial direction perpendicular to the longitudinal direction. A rib extends from the inner periphery. The rib extends from the first end through the second end of the hollow outer elastic rod. The rib includes a longitudinal hole extending from the first end through the second end of the hollow outer elastic cord. An elastic string is received in the longitudinal hole of the rib. The elastic string includes two ends respectively located in the first and second ends of the hollow outer elastic cord. The elastic string has a maximal elongation larger than a maximal elongation of the hollow outer elastic cord.

Applicant believes that another reference corresponds to U.S. Pat. No. 7,819,787 B2, issued on Oct. 26, 2010 to Blake Kassel for Resistance training exercise device, system and method. However, it differs from the present invention because Kassel teaches a resistance training exercise device, system and method having at least one elastic, elongated and hollow cord with a tether secured to each end of the cord and a limit band in the cord to limit the length that the cord may be stretched.

Applicant believes that another reference corresponds to U.S. Pat. No. 7,458,135 B2, issued on Dec. 2, 2008 to Mikesell, et al. for Tether. However, it differs from the present invention because Mikesell, et al. teaches a tether having an elastic member, which provides an unstretched length having a first part and a second part with the first part of the unstretched length having less elastic resistance than a second part of the unstretched length to alter characteristics of stretch and recovery toward the unstretched length under load and unloaded conditions.

Applicant believes that another reference corresponds to U.S. Pat. No. 6,202,263 B1, issued on Mar. 20, 2001 to Shon Les Harker for a Safety sleeve elastic device. However, it differs from the present invention because Harker teaches a safety sleeve elastic device having an elastic member of a certain longitudinal length. The elastic member provides stretching capability of up to seven times the elastic member's original length depending on the material selected. A flexible sleeve member is disposed around the elastic member. The sleeve member is less elastic than the elastic member and provides a stretch limitation to the elastic member to prevent a user from stretching the elastic member beyond a safe elongation. The ends of the sleeve and elastic members are secured proximate to one another. The ends of the elastic members are further secured to connectors. The elastic member provides stretch capability while the sleeve member provides safety features to protect the elastic member and the user.

Applicant believes that another reference corresponds to U.S. Pat. No. 5,800,322, issued on Sep. 1, 1998 to Steve Block for Exercise device and method for forming handles of the device. However, it differs from the present invention because Block teaches an exercise device including an elongated flexible and stretchable tube, a pair of handles, a pair of plugs and a pair of sleeves for securing the handles to respective ends of the elongated tube. The handles each define a hole, and the plugs are received within a channel of the elongated tube adjacent the respective ends of the elongated tube. The plugs prevent the handle from disengaging from the elongated tube. A method is also included for forming each handle, including a method of securing each handle to the elongated tube.

Applicant believes that another reference corresponds to U.S. Pat. No. 6,497,641 B1, issued on Dec. 24, 2002 to Robert Sylvester Hinds for Slotted exercise handgrip. However, it differs from the present invention because Hinds teaches an anchor block having within it a slot as to provide a solid handgrip, strapped handgrip assembly, ankle exercise cuff assembly or anchoring door impingement assembly all of which permit interchangeability of a stoppered elastic exercise cord. The slot may be shaped straight, zigzag or curved.

Applicant believes that another reference corresponds to U.S. Pat. No. 6,923,750 B1, issued on Aug. 2, 2005 to Robert Sylvester Hinds for Multiply slotted exercise handgrip. However, it differs from the present invention because Hinds teaches an anchor block having within it one or more tunnels through which exercise cords are run and an equal number of slots connected to the tunnels, each slot extending from either the face or the backside of the block. In certain cases, some of the slots may extend from the face while others do so from the backside. In other cases, to enhance strength, all of the slots extend solely from the face or from the backside. This slotted arrangement is for a solid handgrip, strapped handgrip assembly, ankle exercise cuff assembly or anchoring door impingement assembly so that stoppered elastic exercise cords may be interchanged. The slot may be shaped straight, zig-zag or curved.

Applicant believes that another reference corresponds to U.S. Pat. No. 6,979,286 B1, issued on Dec. 27, 2005 to Robert Sylvester Hinds for Exercise bar and cord assembly. However, it differs from the present invention because Hinds teaches an exercise bar and cord assembly having a cavity or nest at each end of the bar for connection with a snugly fitting cord emplacement block. The exercise cord, stoppered with a plug in conventional manner, is connected to the block, extending through a tunnel within it. The block may be shaped in any of several ways and a strapped handgrip connection block will serve the purpose. Emplacement channels or slots are optionally present in both the bar and the block. If the block has an axially symmetrical neck, it may be rotated so that the channels are misaligned for improved cord retention. Two modes of exercise are defined in terms of the cord's anchoring means that is, whether its ends or a mid-portion of it.

Applicant believes that another reference corresponds to U.S. Pat. No. 7,344,485 B1, issued on Mar. 18, 2008 to Simpson, et al. for Sports training and exercise device. However, it differs from the present invention because Simpson, et al. teaches a resistance exercise device including a length of resilient tubing having first and second free ends. Strap handles are connected to the free ends of the tubing. The resilient tubing is threaded through at least one oversized tubular section, constructed of rubberized foam, which section provides padding at pressure points when the resilient tubing is positioned across or around a user while exercising. A support strap is connected to the first tubular section. In a second embodiment, the belt includes a buckle for buckling the free ends of the belt together and a "D"-ring mounted to one side of the belt. A karabiner is used to connect a strap handle to a "D"-ring.

Applicant believes that another reference corresponds to U.S. Pat. No. 7,357,762 B1, issued on Apr. 15, 2008 to Terry, et al. for Reinforced cord well lifting bar assembly. However, it differs from the present invention because Terry, et al. teaches an exercise bar cord impingement assembly permitting exercise in two modes, defined in terms of how cord anchoring is arranged. It also permits exercise to be conducted either with a stretchable cord and handgrip together connected to the bar's body or just the stretchable cord itself so connected. There are slots in the bar's body to slide the cord through. Wells or nests accommodate impingement of the elastic cord and firm handgrip emplacement. The ends of the bar's body are preferably shaped into pipe bowl configuration disposed to insure a good fit and avoid torque.

Other patents describing the closest subject matter provide for a number of more or less complicated features that fail to solve the problem in an efficient and economical way. None of these patents suggest the novel features of the present invention.

SUMMARY OF THE INVENTION

The present invention is an elastic exercise safety cord assembly, comprising an elastic tubing having opposing first and second ends, an exterior wall, and an elongated cavity having a first diameter. The elastic tubing stretches a first predetermined length.

First and second end plugs are wider than the first diameter. The first and second end plugs each have a hollow core through their entire length and are secured inside the elongated cavity at the respective first and second ends, with a widest portion of each first and second end plugs closest to its respective first and second ends. The first and second end plugs may be tapered. The first and second end plugs comprise a sidewall and a plug end.

A cord has opposing third and fourth ends that is threaded through the elastic tubing and the first and second end plugs. The cord is a second predetermined length that is shorter than the first predetermined length.

The cord comprises end knots at the third and fourth ends. The cord keeps the elastic tubing attached and confined if the elastic tubing breaks to prevent the elastic tubing from striking and/or causing damage to person and/or property. The elastic tubing can fit onto an attachment device that has a continuous channel going through its entire length. The continuous channel is of a sufficient diameter as to allow the elastic tubing to pass through it, but not the first and second end plugs. The attachment device can be a docking block and/or a handle assembly.

Further comprising first and second inserts that are sufficiently flexible to permit the cord to fit through. The first and second inserts comprise a sidewall, a hole, and an insert end. The sidewall comprises a slit. The end knots are secured by the respective first and second inserts. The first and second inserts are secured within the respective first and second end plugs.

The docking block comprises a sidewall and fifth and sixth ends. The docking block further comprises a block cavity defined by the continuous channel. The docking block further comprises openings and at least one channel slit.

The handle assembly comprises a handle cavity defined by the continuous channel, and comprises at least one handle slit.

It is therefore one of the main objects of the present invention to provide an elastic exercise safety cord assembly comprising a cord extending through an elastic tubing, and having first and second end plugs at the elastic tube's ends.

It is another object of this invention to provide an elastic exercise safety cord assembly, whereby the first and second end plugs have a larger diameter than the elastic tubing, thus securing each end of the elastic tubing in a docking block, whereby the elastic tubing runs through a channel narrower than the end plugs.

It is another object of this invention to provide an elastic exercise safety cord assembly, whereby the first and second end plugs create obstructions at the ends of the elastic tubing passing through a narrower channel.

It is another object of this invention to provide an elastic exercise safety cord assembly, whereby the elastic tubing stretches a first predetermined length, the cord is a second predetermined length, and the second predetermined length is shorter than the first predetermined length.

It is another object of this invention to provide an elastic exercise safety cord assembly, whereby the cord functions to limit the length that the elastic tubing will stretch, and avoids and reduces bodily injury or property damage in the event the elastic tubing happens to break or snap.

It is another object of this invention to provide an elastic exercise safety cord assembly that may be attached or loaded to existing docking blocks that currently have no replaceable elastic tubing.

It is another object of this invention to provide an elastic exercise safety cord assemblies in a variety of tensions and lengths, which in turn allow for more exercise applications.

It is another object of this invention to provide an elastic exercise safety cord assembly that is more economical than replacing existing docking blocks that currently have no replaceable elastic tubing.

It is another object of this invention to provide an elastic exercise safety cord assembly that may be easily and conveniently secured onto existing handles, straps, and other anchoring equipment to create variable resistance for various exercises.

It is another object of this invention to provide an elastic exercise safety cord assembly of various thicknesses, densities, and tension characteristics.

It is another object of this invention to provide durable and reliable elastic exercise safety cord assembly.

It is yet another object of this invention to provide such an elastic exercise safety cord assembly that is inexpensive to configure, implement, and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
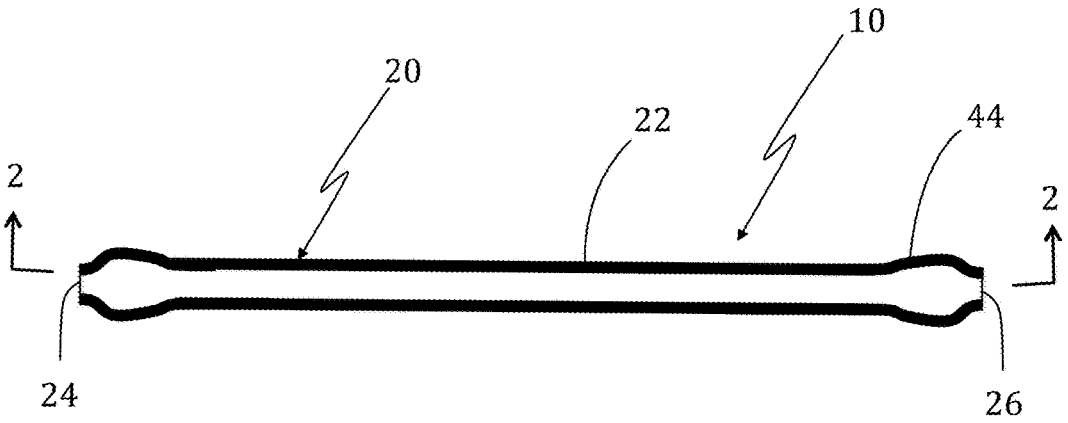
FIG. 1 is an elevation view of the present invention.

Referring now to the drawings, the present invention is an elastic exercise safety cord assembly and is generally referred to with numeral 10. It can be observed that it basically includes elastic tubing 20, cord 40, and first and second end plugs 50.

Figure 2:
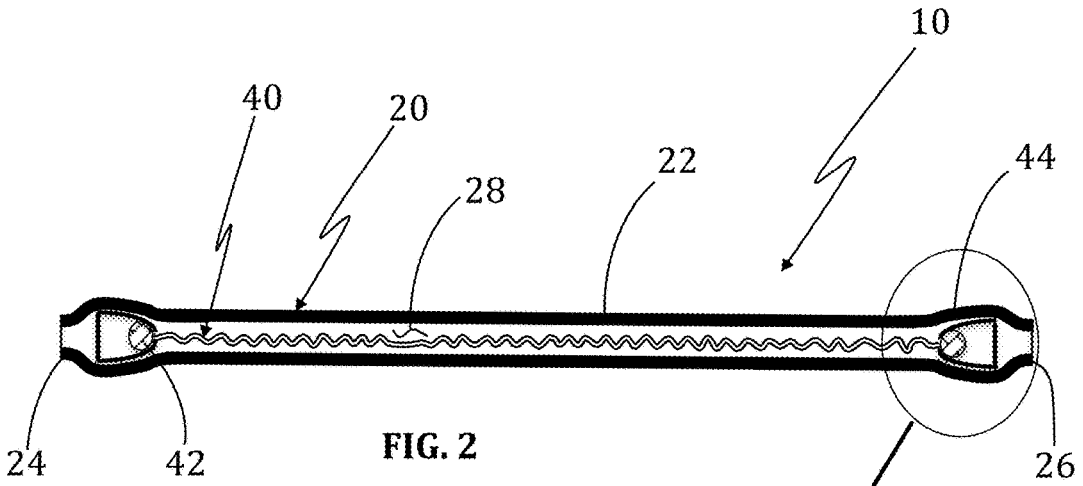
FIG. 2 is a cross-section view of the present invention taken along the lines 2-2 as seen in FIG. 1.

As seen in FIGS. 1 and 2, present invention 10 comprises elastic tubing 20 having exterior wall 22, and ends 24 and 26. Cord 40 extends through elongated cavity 28 of elastic tubing 20 and has end knots 42 and 44. Cord 40 also has first and second end plugs 50 at ends 24 and 26.

Figure 3:
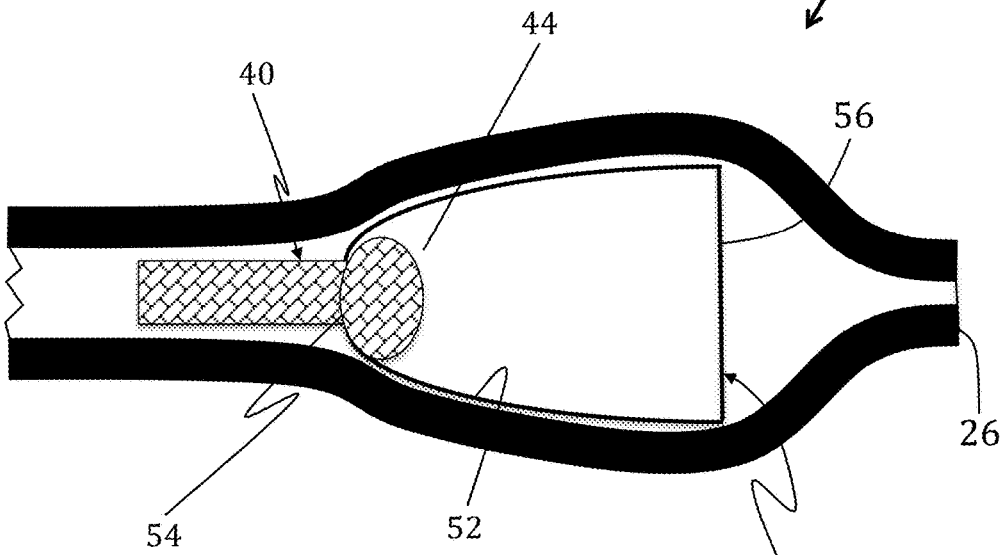
FIG. 3 is a close up cross-section view of one end of the present invention as seen in FIG. 2.

As seen in FIG. 3, end plugs 50 each comprise sidewall 52, plug end 56, and hollow core 54 to permit cord 40 to fit there through. It is noted that hollow core 54 is smaller in diameter than end knot 42 or 44.

Figure 4A:
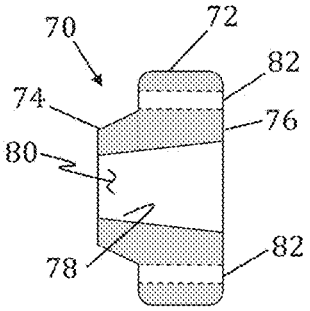
FIG. 4A is a perspective view of the present invention secured onto a preferred embodiment of a docking block and a preferred embodiment of a handle assembly.
Figure 4B:
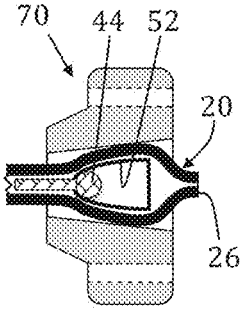
FIG. 4B is a cross-section view of the present invention secured onto the preferred embodiment of the docking block as seen in FIG. 4A.

As seen in FIGS. 4A and 4B, present invention 10 is secured onto a preferred embodiment docking block 70 and a preferred embodiment handle assembly 90.

Figure 4C:
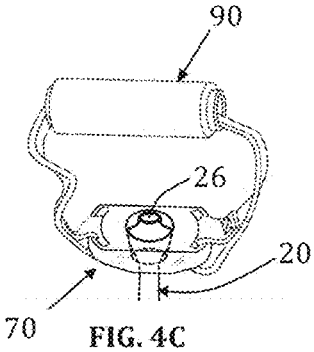
FIG. 4C is a cross-section view of the docking block as seen in FIG. 4A.

As seen in FIGS. 4B and 4C, docking block 70 comprises sidewall 72 and ends 74 and 76. Docking block 70 further comprises channel 78 that defines block cavity 80, and openings 82 to receive straps of handle assembly 90. In this preferred embodiment, end knot 44, which is secured within end plug 50, which in turn is within end 26, are wedged within block cavity 80 that is tapered in this embodiment, whereby end plugs 50 have a larger diameter than elastic tubing 20. Thus, securing each end of elastic tubing 20 in docking block 70, whereby elastic tubing 20 runs through channel 78 that is narrower than end plugs 50.

Figure 5A:
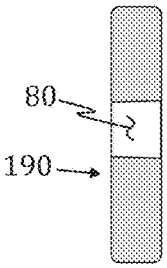
FIG. 5A is a perspective view of the present invention secured onto a first alternate embodiment of the handle assembly.
Figure 5B:
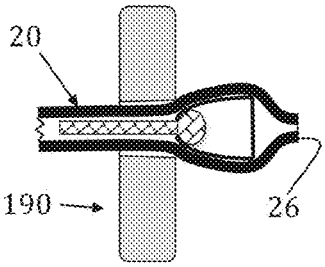
FIG. 5B is a cross-section view of the present invention secured onto the first alternate embodiment of the handle assembly as seen in FIG. 5A.

As seen in FIGS. 5A and 5B, present invention 10 is secured onto a first alternate embodiment handle assembly 190.

Figure 5C:
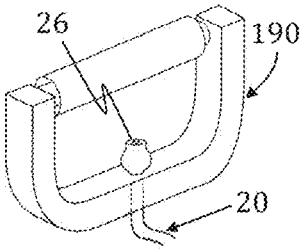
FIG. 5C is a cross-section view of the first alternate embodiment of the handle assembly as seen in FIG. 5A.

As seen in FIGS. 5B and 5C, end knot 44, which is secured within end plug 50, which in turn is within end 26 are secured by handle assembly 190 having handle cavity 94 defined by channel 96.

Figure 6A:
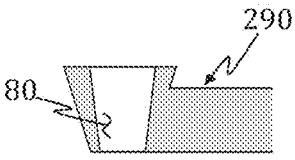
FIG. 6A is a first perspective view of the present invention being secured onto a second alternate embodiment of the handle assembly.
Figure 6B:
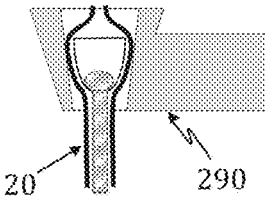
FIG. 6B is a second perspective view of the present invention secured onto the second alternate embodiment of the handle assembly as seen in FIG. 6A.

As seen in FIGS. 6A and 6B, present invention 10 is secured onto a second alternate embodiment handle assembly 290.

Figure 6C:
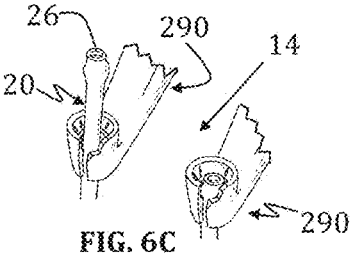
FIG. 6C is a cross-section view of the present invention secured onto the second alternate embodiment of the handle assembly as seen in FIG. 6B.

As seen in FIG. 6C, in this embodiment, end knot 44, which is secured within end plug 50, which in turn is within end 26, are wedged within handle assembly 290 having handle cavity 94 defined by channel 96.

Figure 7A:
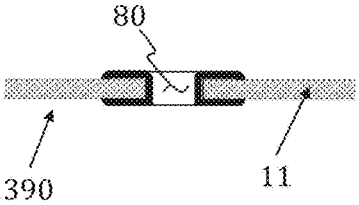
FIG. 7A is a perspective view of the present invention secured onto a third alternate embodiment of the handle assembly.
Figure 7B:
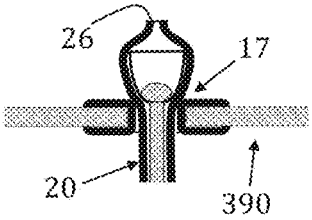
FIG. 7B is a cross-section view of the present invention secured onto the third alternate embodiment of the handle assembly as seen in FIG. 7A.

As seen in FIGS. 7A and 7B, present invention 10 is secured onto a third alternate embodiment handle assembly 390.

Figure 7C:
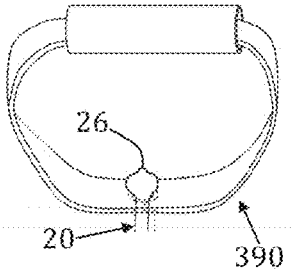
FIG. 7C is a cross-section view of the third alternate embodiment of the handle assembly as seen in FIG. 7A.

As seen in FIGS. 7B and 7C, end knot 44, which is secured within end plug 50, which in turn is within end 26, are secured by handle assembly 390 having handle cavity 94 defined by channel 96.

Figure 8A:
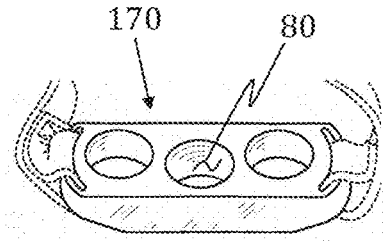
FIG. 8A is a perspective view of a first alternate embodiment of the docking block.

Seen in FIG. 8A is a perspective view of a first alternate embodiment docking block 170 comprising three block cavities 80 defined by respective channels 78.

Figure 8B:
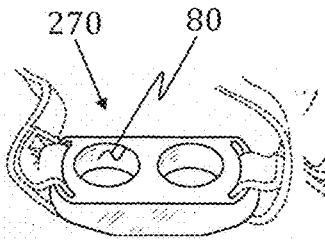
FIG. 8B is a perspective view of a second alternate embodiment of the docking block.

Seen in FIG. 8B is a perspective view of a second alternate embodiment docking block 270 comprising two block cavities 80 defined by respective channels 78.

Figure 8C:
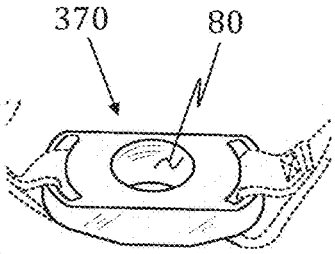
FIG. 8C is a perspective view of a third alternate embodiment of the docking block.

Seen in FIG. 8C is a perspective view of a third alternate embodiment docking block 370 comprising block cavity 80 defined by respective channel 78.

Figure 9A:
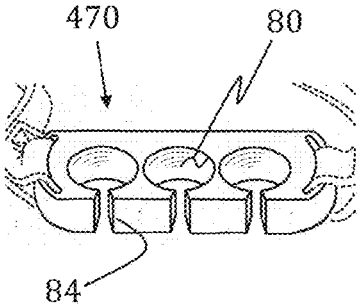
FIG. 9A is a perspective view of a fourth alternate embodiment of the docking block.

Seen in FIG. 9A is a perspective view of a fourth alternate embodiment docking block 470 comprising three block cavities 80 defined by respective channels 78, each with a respective channel slit 84.

Figure 9B:
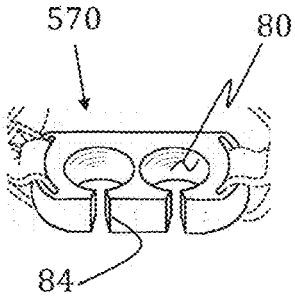
FIG. 9B is a perspective view of a fifth alternate embodiment of the docking block.

Seen in FIG. 9B is a perspective view of a fifth alternate embodiment docking block 570 comprising two block cavities 80 defined by respective channels 78, each with a respective channel slit 84.

Figure 9C:
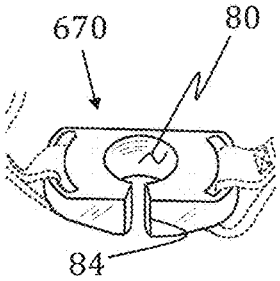
FIG. 9C is a perspective view of a sixth alternate embodiment of the docking block.

Seen in FIG. 9C is a perspective view of a sixth alternate embodiment docking block 670 comprising block cavity 80 defined by respective channel 78 with respective channel slit 84.

Figure 10:
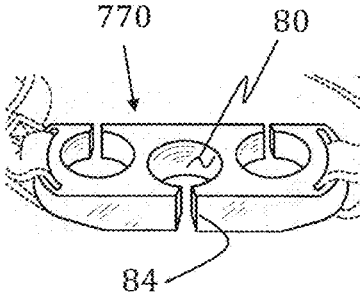
FIG. 10 is a perspective view of a seventh alternate embodiment of the docking block.

Seen in FIG. 10 is a perspective view of a seventh alternate embodiment docking block 770 comprising three block cavities 80 defined by respective channels 78, each with a respective channel slit 84.

Figure 11A:
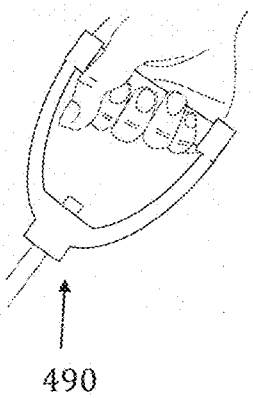
FIG. 11A is a perspective view of a fourth alternate embodiment of the handle assembly.

Seen in FIG. 11A is a perspective view of a fourth alternate embodiment handle assembly 490.

Figure 11B:
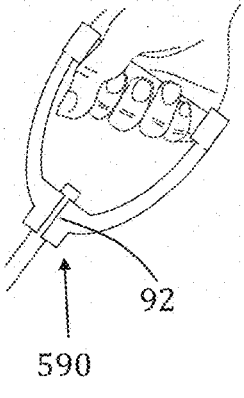
FIG. 11B is a perspective view of a fifth alternate embodiment of the handle assembly.

Seen in FIG. 11B is a perspective view of a fifth alternate embodiment handle assembly 590 with handle slit 92.

Figure 12:
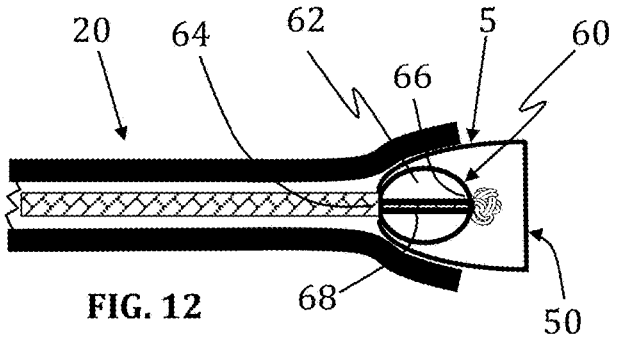
FIG. 12 is a close up cross-section view of one end of the present invention further comprising a preferred embodiment of an insert.

Seen in FIG. 12 is a close up cross-section view of one end of present invention 10 further comprising a preferred embodiment insert 60. Insert 60 comprises sidewall 62, hole 64, insert end 66, and slit 68. Insert 60 is sufficiently flexible to permit cord 40 to fit therethrough. In this embodiment, end knot 44 is secured by insert 60, which is secured within end plug 50, which in turn is within end 26.

Figure 13A:
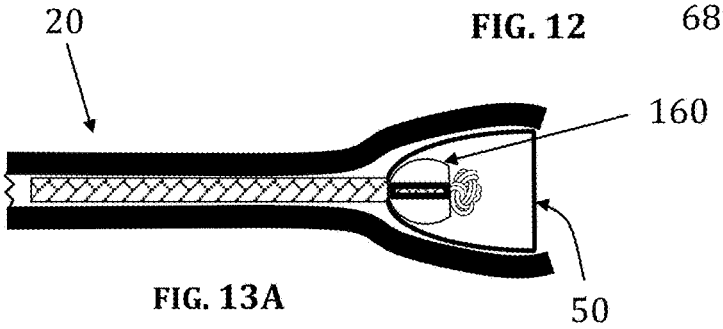
FIG. 13A is a close up cross-section view of one end of the present invention further comprising a first alternate embodiment of the insert.
Figure 13B:
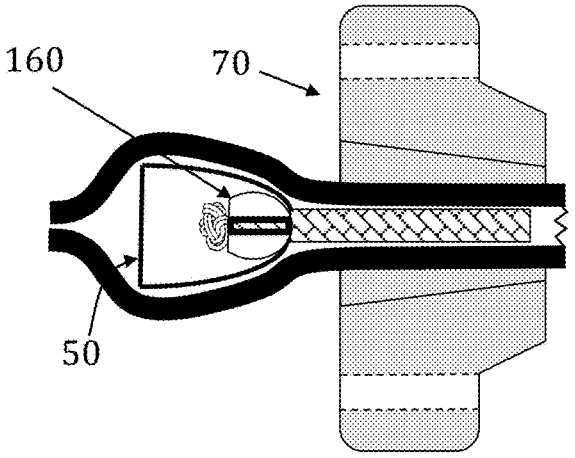
FIG. 13B is a close up cross-section view of one end of the present invention further comprising the first alternate embodiment of the insert being secured onto the preferred embodiment of the docking block seen in FIG. 4C.
Figure 13C:
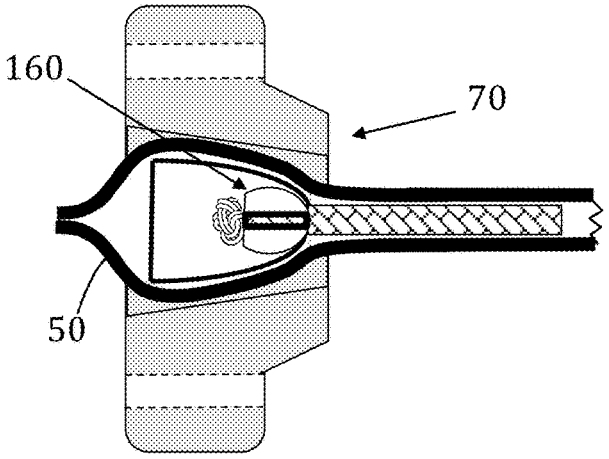
FIG. 13C is a close up cross-section view of one end of the present invention further comprising the first alternate embodiment of the insert secured onto the preferred embodiment of the docking block seen in FIG. 4C.

Seen in FIGS. 13A, 13B, and 13C is a close up cross-section view of one end of present invention 10 further comprising a first alternate embodiment insert 160. In this embodiment, end knot 44 secured by insert 160, which is secured within end plug 50, which in turn is within end 26, are wedged within block cavity 80.

Figure 14:
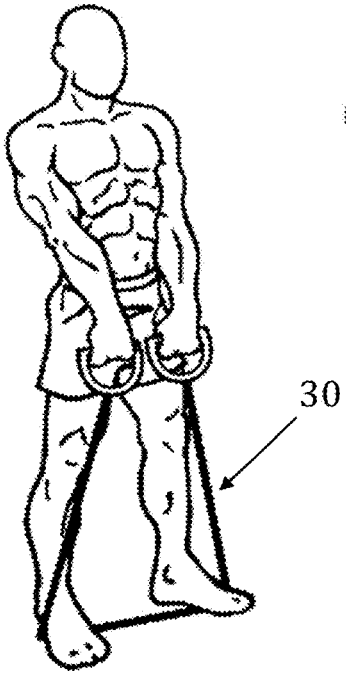
FIG. 14 Prior Art
FIG. 14 is a first perspective view of a user exercising with a prior art elastic band assembly.

Seen in FIG. 14 is a first perspective view of a user exercising with prior art elastic band assembly 30.

Figure 15:
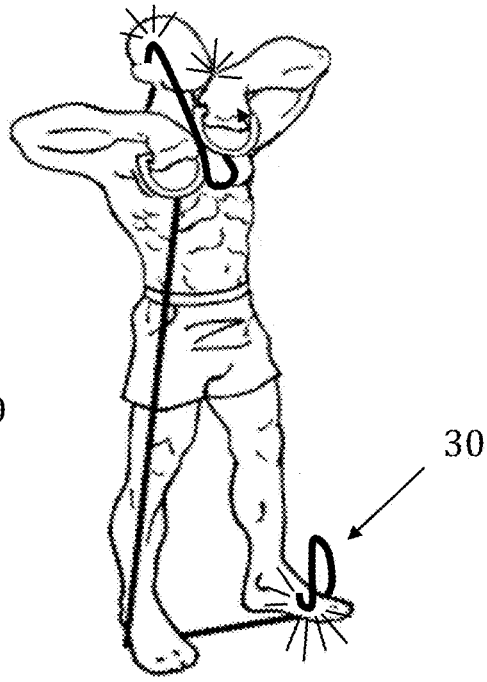
FIG. 15 is a second perspective view of the prior art elastic band assembly snapping and striking the user while the user is exercising.

Seen in FIG. 15 is a second perspective view of prior art elastic band assembly 30 snapping and striking the user while the user is exercising.

Figure 16:
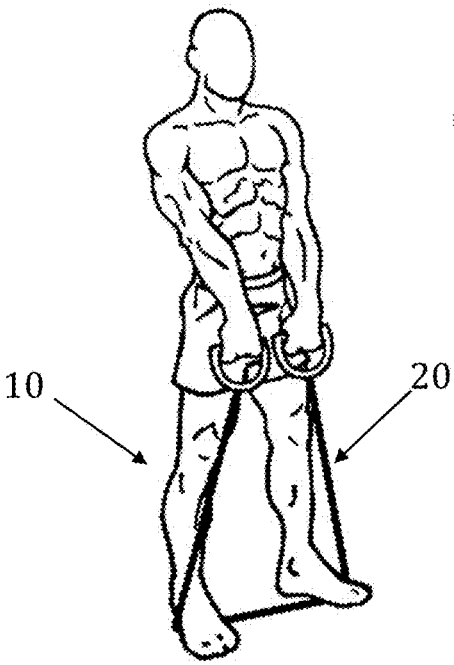
FIG. 16 is a first perspective view of the user exercising with the present invention.

Seen in FIG. 16 is a first perspective view of a user exercising with present invention 10.

Figure 17:
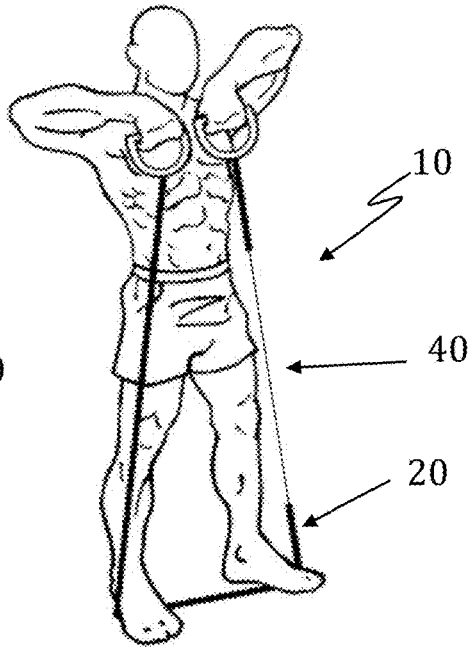
FIG. 17 is a second perspective view of the elastic tubing of the present invention snapping without striking the user while the user is exercising.

Seen in FIG. 17 is a second perspective view of elastic tubing 20, of present invention 10, snapping without striking the user while the user is exercising, whereby elastic tubing 20 stretches a first predetermined length and cord 40 is a second predetermined length and the second predetermined length is shorter than the first predetermined length, but the elastic tubing 20 fails or breaks. As an example, elastic tubing 20 may fail or break due to continuous use, becoming brittle, defect(s), etc. Cord 40 therefore functions to limit the length that elastic tubing 20 will stretch, and avoids and/or reduces bodily injury or property damage in the event elastic tubing 20 happens to break or snap. Cord 40 further functions to prevent the overstretching of elastic tubing 20 and therefore provides a longer lifespan to present invention 10.

Present invention 10 may be attached or loaded to existing docking blocks, such as but not limited to, docking blocks 70, 170, 270, 370, 470, 570, 670, and/or 770 that do not have replaceable elastic tubing. Present invention 10 is of a variety of tensions and lengths, which in turn allow for more exercise applications. Present invention 10 may be easily and conveniently secured onto existing handle assemblies with or without straps, such as but not limited to, handle assemblies 90, 190, 290, 390, 490, and/or 590, and other anchoring equipment to create variable resistance for various exercises. Present invention 10 is of various thicknesses, densities, and tension characteristics that are durable and reliable.

It is noted that all docking blocks, including docking blocks 70, 170, 270, 370, 470, 570, 670, and 770, and all handle assemblies, including handle assemblies 90, 190, 290, 390, 490, and 590 are defined as attachment devices.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An elastic exercise safety cord assembly, comprising:

A) an elastic tubing having opposing first and second ends, an exterior wall, and an elongated cavity having a first diameter, said elastic tubing stretches to a first predetermined length;

B) first and second end plugs wider than said first diameter, said first and second end plugs each have a hollow core through an entire length of said first and second end plugs and are secured inside said elongated cavity at respective said first and second ends, with a widest portion of each said first and second end plugs closest to its respective said first and second ends;

C) a cord having opposing third and fourth ends, said cord threaded through said elastic tubing and said first and second end plugs, said cord is a second predetermined length that is shorter than said first predetermined length, said cord comprises end knots at each of said third and fourth ends, said cord keeps said elastic tubing attached and confined when said elastic tubing breaks to prevent said elastic tubing from striking and/or causing damage to person and/or property; and D) first and second inserts being flexible to permit said cord to fit through said first and second inserts.

2. The elastic exercise safety cord assembly set forth in claim 1, further characterized in that said elastic tubing is configured to fit onto an attachment device that has a continuous channel going through an entire length, said continuous channel being of a sufficient diameter as to allow said elastic tubing to pass through it but not said first and second end plugs.

3. The elastic exercise safety cord assembly set forth in claim 2, further characterized in that said attachment device is a docking block.

4. The elastic exercise safety cord assembly set forth in claim 3, further characterized in that said docking block comprises a sidewall and fifth and sixth ends.

5. The elastic exercise safety cord assembly set forth in claim 3, further characterized in that said docking block further comprises a block cavity defined by said continuous channel.

6. The elastic exercise safety cord assembly set forth in claim 3, further characterized in that said docking block further comprises openings.

7. The elastic exercise safety cord assembly set forth in claim 3, further characterized in that said docking block further comprises at least one channel slit.

8. The elastic exercise safety cord assembly set forth in claim 2, further characterized in that said attachment device is a handle assembly.

9. The elastic exercise safety cord assembly set forth in claim 8, further characterized in that said handle assembly comprises a handle cavity defined by said continuous channel.

10. The elastic exercise safety cord assembly set forth in claim 8, further characterized in that said handle assembly comprises at least one handle slit.

11. The elastic exercise safety cord assembly set forth in claim 1, further characterized in that each of said first and second inserts comprise a sidewall, a hole, and an insert end.

12. The elastic exercise safety cord assembly set forth in claim 11, further characterized in that said sidewall comprises a slit.

13. The elastic exercise safety cord assembly set forth in claim 1, further characterized in that said end knots are secured by respective said first and second inserts.

14. The elastic exercise safety cord assembly set forth in claim 13, further characterized in that said first and second inserts are secured within respective said first and second end plugs.

15. The elastic exercise safety cord assembly set forth in claim 1, further characterized in that said first and second end plugs are tapered.

16. The elastic exercise safety cord assembly set forth in claim 1, further characterized in that each of said first and second end plugs comprise a sidewall and a plug end.

* * * * *